US006742877B2

(12) United States Patent
Usui et al.

(10) Patent No.: US 6,742,877 B2
(45) Date of Patent: Jun. 1, 2004

(54) INK-JET RECORDING APPARATUS

(75) Inventors: Takamasa Usui, Ogaki (JP); Hikaru Kaga, Aichi-ken (JP); Tsuyoshi Suzuki, Owariasahi (JP)

(73) Assignee: Brother Kogyo Kabushiki Kaisha, Aichi-ken (JP)

( * ) Notice: Subject to any disclaimer, the term of this patent is extended or adjusted under 35 U.S.C. 154(b) by 0 days.

(21) Appl. No.: 10/302,017

(22) Filed: Nov. 22, 2002

(65) Prior Publication Data

US 2003/0117466 A1 Jun. 26, 2003

(30) Foreign Application Priority Data

Nov. 29, 2001 (JP) ..... 2001-363817

(51) Int. Cl.[7] ..... B41J 2/175
(52) U.S. Cl. ..... 347/85; 347/22
(58) Field of Search ..... 347/85, 86, 87, 347/92

(56) References Cited

U.S. PATENT DOCUMENTS 4,806,955 A * 2/1989 Koto et al. ..... 347/30
5,768,991 A * 6/1998 Cless et al. ..... 101/227
6,007,193 A * 12/1999 Kashimura et al. ..... 347/92
6,270,205 B1 * 8/2001 Takata ..... 347/85
6,517,189 B2 * 2/2003 Ogawa et al. ..... 347/35

* cited by examiner

*Primary Examiner*—Anh T. N. Vo
(74) *Attorney, Agent, or Firm*—Reed Smith LLP

(57) ABSTRACT

An ink-jet recording apparatus includes an ink tube and an air discharge tube which has a cylindrical shape and an inside diameter that is larger than an outside diameter of the ink tube. The air discharge tube is provided so as to surround the ink tube. Therefore, a circular enclosed space is provided around the ink tube, between the air discharge tube and the ink tube. A pressure reducing device is connected with the enclosed space to reduce pressure therein. By actuating the pressure reducing device, the pressure in the enclosed space is reduced. Thus, air contained in ink is sucked into the enclosed space, in which the pressure is reduced, through a wall of the ink tube, and thus, generation of air bubbles are restricted in the ink tube.

21 Claims, 6 Drawing Sheets

INK-JET RECORDING APPARATUS

BACKGROUND OF THE INVENTION

1. Field of Invention

The invention relates to an ink-jet recording apparatus, and more particularly, an ink-jet recording apparatus of ink tube supply type wherein generation of air bubbles in an ink tube is restricted to maintain excellent printing quality.

2. Description of Related Art

An ink-jet recording apparatus of an ink tube supply type supplies ink to a recording head via an ink tube from an ink tank. In the ink-jet recording apparatus of this type, one end of the ink tube is connected with the ink tank provided separately from a carriage, and the other end is connected with the recording head mounted on the carriage. Thus, the recording head and the ink tank are connected with each other via the ink tube. Ink stored in the ink tank is supplied to the recording head via the ink tube. The ink tank connected with one end of the ink tube is fixedly provided. The recording head connected with the other end of the ink tube is mounted on the carriage and reciprocates in a main scanning direction. Accordingly, the ink tube requires flexibility and durability to bending/warping. In order to satisfy such requirements, the ink tube is made of olefin rubber, such as ethylene rubber and butadiene rubber.

Generally, a negative pressure is applied to the ink to be supplied to the recording head, so that air is likely to get into the ink through walls of the ink tank and the ink tube because of pressure difference between inside and outside of the ink tank and the ink tube. In particular, because the ink tube is made of the olefin rubber, the ink tube has air-permeability. This characteristic allows air to get into the ink through the wall of the ink tube to generate air bubbles in the ink tube. The air bubbles generated in the ink tube are conveyed to the recording head with contained in the ink, and the air bubbles may close an ink flow path or ink nozzle. This may cause non-ejection of the ink or deterioration of the printing quality.

SUMMARY OF THE INVENTION

The invention provides an ink-jet recording apparatus, wherein generation of air bubbles in an ink tube is restricted to maintain excellent printing quality.

According to one aspect of the invention, an ink-jet recording apparatus includes a recording head that ejects ink, an ink tank that is provided separately from the recording head and stores the ink therein, an ink tube that supplies the ink from the ink tank to the recording head, a member that provides an enclosed space, extending along at least a portion of the ink tube, and a pressure reducing device that reduces pressure in the enclosed space.

In the ink-jet recording apparatus described above, the ink stored in the ink tank is supplied to the recording head through the ink tube. The ink tube is provided with the enclosed space by the member which extends along at least one portion of the ink tube. The pressure of the enclosed space is reduced by the pressure reducing device. Thus, air contained in the ink is sucked into the enclosed space, in which the pressure is reduced. With this structure, generation of air bubbles in the ink tube is restricted.

In another aspect of the invention, an ink-jet recording apparatus includes a recording head that ejects ink, an ink tank that stores the ink, and an ink tube coupled between the recording head and the ink tank to supply the ink from the ink tank to the recording head. An air discharge member extends along the ink tube and is connected to a vacuum source that reduces pressure in the air discharge member to reduce air bubbles in the ink contained in the ink tube.

In another aspect of the invention, an ink-jet recording apparatus includes an ink tank that stores ink, a recording head that ejects the ink and is provided separately from the ink tank, and an ink tube coupled between the recording head and the ink tank to supply the ink from the ink tank to the recording head. An air discharge tube extending along the ink tube and having an air permeable wall is provided. Also, a vacuum source is connected to the air discharge tube to reduce the pressure therein to draw air bubbles present in the ink in the ink tube through the air permeable wall.

In yet another aspect of the invention, a method of supplying ink to a recording head is provided. The method includes providing an ink tube that connects an ink tank that stored ink to a recording head that ejects the ink, and placing an air discharge member that extends along the ink tube. The pressure in the air discharge member is lowered to reduce air bubbles in the ink contained in the ink tube.

BRIEF DESCRIPTION OF THE DRAWINGS

The invention will be described with reference to the accompanying drawings, in which like elements are labeled with like numbers and in which.

DETAILED DESCRIPTION OF THE PREFERRED EMBODIMENTS

Figure 1:
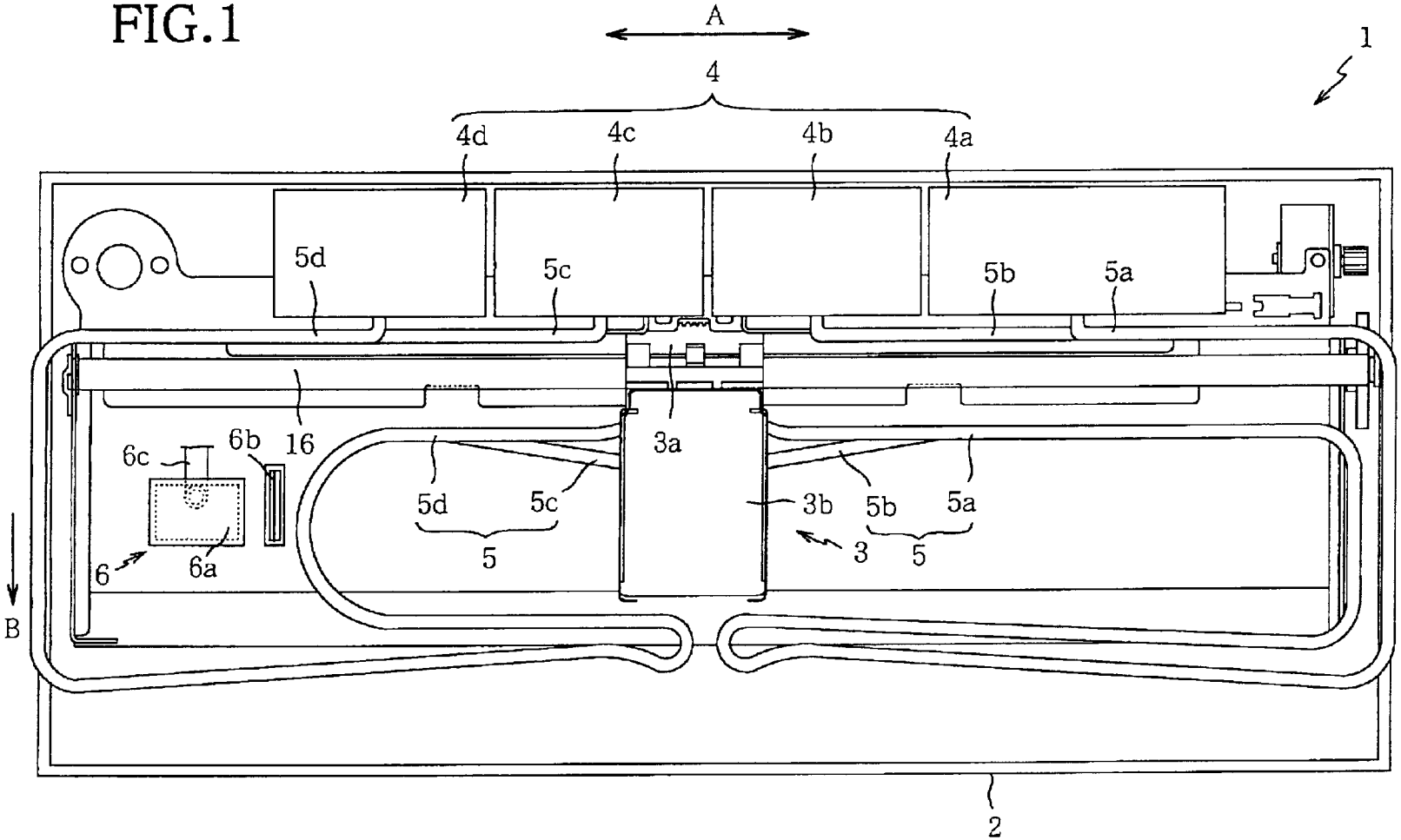
FIG. 1 is a plan view showing an internal structure of an ink-jet recording apparatus, to which exemplary embodiments of the invention is applied.

Exemplary embodiments of the invention will be described with reference to the accompanying drawings. As shown in FIG. 1, an ink-jet recording apparatus 1 includes a body frame 2, a recording head unit 3 provided in the body frame 2, an ink tank 4 (ink tanks 4*a* to 4*d*) for storing ink to be supplied to the recording head unit 3, an ink tube 7 (FIG. 2) for supplying the ink to the recording head unit 3 from the ink tank 4, a purge device 6, and sheet feed rollers for feeding a recording sheet. The recording head unit 3 ejects ink droplets onto a recording sheet. The ink tanks 4*a* to 4*d* each contains ink to be supplied to the recording head unit 3.

The body frame 2 is substantially in rectangular box shape and made of flame-retardant plastic. The body frame 2 contains the recording head unit 3 and other parts therein. A guide rod 16 is provided so as to extend in a longitudinal direction of the body frame 2. The guide rod 16 supports the recording head unit 3 so that the recording head unit 3 can travel in directions indicated by an arrow A (right-and-left directions in FIG. 1) orthogonal to a sheet feed direction indicated by an arrow B.

The recording head unit 3, having a substantially box shape, includes a carriage 3*a* and a housing 3*b* connected to the carriage 3*a*, and contains recording heads (not shown) therein. The guide rod 16 is slidably inserted into the carriage 3*a* so that the carriage 3*a* can reciprocate along the guide rod 16. A belt (not shown) is attached to the carriage 3*a* and is wound around a roller (not shown) attached to a carriage motor (not shown). When the carriage motor runs, the belt is driven, which allows the carriage 3*a* with the recording head unit 3 to move for the distance the belt is driven.

The recording head unit 3 is equipped with a plurality of the recording heads for recording in full color. Each of the recording heads has a plurality of nozzles, which open downwardly to face the recording sheet. In this embodiment, for example, four recording heads are provided. The recording heads eject ink droplets from the nozzles by the action of piezoelectric actuators provided on ink chambers, in the same manner as a well-known recording head. The recording heads are supported at the undersurface of the housing 3*b* of the recording head unit 3. The recording heads of the recording sheet side are covered with a cover plate, except the nozzles.

The sheet feed rollers, as a sheet feed device, are disposed at a lower position of the recording head unit 3 to feed the recording sheet in the sheet feed direction B. The sheet feed rollers are placed upstream and downstream in the sheet feed direction B with respect to the recording head unit 3. The sheet feed rollers feed the recording sheet in a substantially horizontal direction (the direction B) by rotation of a sheet feed motor (not shown).

The ink tank 4 is designed to store ink to be supplied to the recording heads, and disposed at a lower portion of a sheet feed path. In the embodiment, the ink tank 4 includes four ink tanks 4*a* to 4*d* to store black, yellow, cyan, and magenta inks in the identified order. The ink tube 7 includes four ink tubes to connect the ink tanks 4*a* to 4*d* with the recording head unit 3. Air discharge tubes 5*a* to 5*d* (air discharge tube 5) are provided to the respective ink tubes 7 to surround the ink tubes 7 therein. One end of each of the ink tubes 7 is attached to the corresponding ink tank 4*a* to 4*d* so as to supply the respective color ink of black, yellow, cyan and magenta to the recording head unit 3. The other end of each of the ink tubes 7 is connected to the recording head for the corresponding color ink. The respective color inks are ejected from the recording heads, enabling full-color printing on the recording sheet. The air discharge tube 5 surrounding the ink tube 7 will be described later.

The purge device 6 is provided on a left end of the body frame 2 to perform a purging operation. The purging operation is a process to recover ink ejection of the recording heads. The purge device 6 includes a suction cap 6*a*, a suction pump (not shown) that sucks ink from the recording head unit 3 through the suction cap 6*a*, and a wiper 6*b* that wipes the nozzle surfaces of the recording head unit 3.

The suction cap 6*a*, having a substantially box shape, hermetically seals the nozzles of the recording heads. A discharge tube 6*c* is attached to the bottom of the suction cap 6*a*. Ink sucked by the action of the suction pump is discharged from the recording heads via the suction cap 6*a* and the discharge tube 6*c*. When the sucking operation with respect to all the recording heads is complete, the suction cap 6*a* is released from the nozzle surfaces. The nozzle surfaces become dirty with ink due to the purging operation, so that the nozzle surfaces are wiped using the plate-shaped rubber wiper 6*b* to remove the ink. Then, the purging operation is complete. The purge device 6 may be designed to generate an ink-flow faster than that at the recording operation in the recording heads by applying a high pressure to the ink from the ink tanks 4*a* to 4*d*.

A control circuit board (not shown), on which a CPU, a ROM, a RAM and other control devices are mounted, is provided inside the body frame 2. The control circuit board controls the ink-jet recording apparatus 1 according to control programs related to operation of the ink-jet recording apparatus 1. The purging operation by the purge device 6 is also controlled by the control circuit board.

Figure 2:
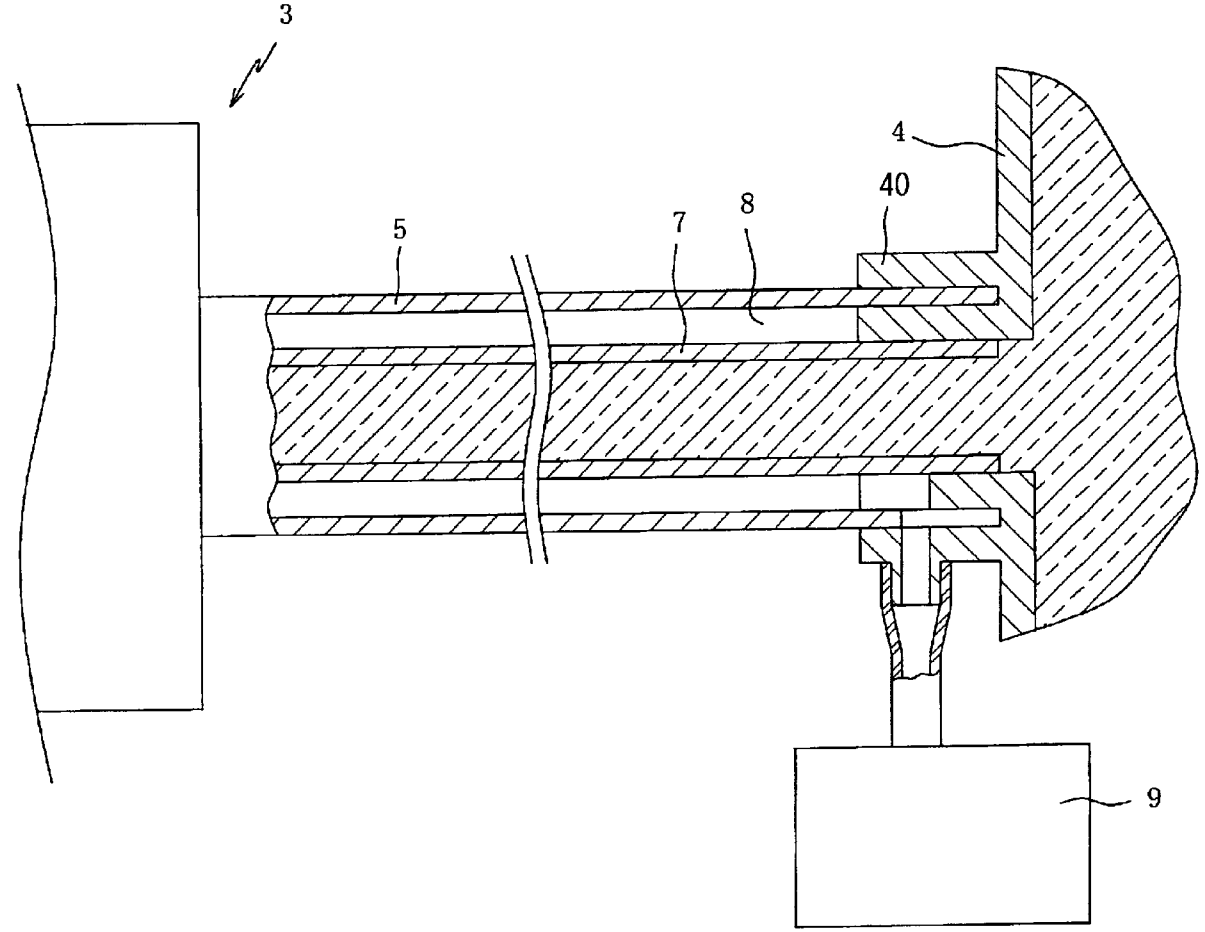
FIG. 2 is an enlarged sectional view showing an ink tube and an air discharge tube of a first embodiment of the invention.

Referring to FIG. 2, the air discharge tube 5 will be described. All of the air discharge tubes 5*a* to 5*d* surrounding the ink tubes 7 have the same structure, so that only one of them will be described below. The air discharge tube 5, made of a well-known flexible tube material similar to that for the ink tube 7, provides an enclosed space 8 to extend along the ink tube 7 between the air discharge tube 5 and the ink tube 7. The air discharge tube 5 has a cylindrical shape having an inside diameter which is larger than an outside diameter of the ink tube 7 so as to surround the ink tube 7 therein. Thus, the circular enclosed space 8 is provided around the ink tube 7 between the air discharge tube 5 and the ink tube 7. A pressure reducing device 9 (e.g. a vacuum pump) is connected with the enclosed space 8 to reduce the pressure in the enclosed space 8. By actuating the pressure reducing device 9, the pressure in the enclosed space 8 can be reduced so as to become lower than the atmospheric pressure. The pressure reducing device 9 is preferably connected to a connector 40, having stiffness, of the recording head unit 3 or the ink tank 4 engaged with the ink tube 7 and the air discharge tube 5.

According to the ink-jet recording apparatus 1 of the invention structure as described above, one end of the ink tube 7 is connected with the respective ink tank 4 provided separately from the carriage 3*a*. The other end of the ink tube 7 is connected with the recording head unit 3 mounted on the carriage 3*a*. The ink stored in the ink tank 4 is supplied to the respective recording heads via the ink tube 7. As described above, the ink tube 7 requires flexibility and durability to bending/warping, so that the ink tube 7 is made of olefin rubber, such as ethylene rubber and butadiene rubber.

The enclosed space 8 is provided between the ink tube 7 and the air discharge tube 5, and the pressure in the enclosed space 8 is reduced by actuating the pressure reducing device 9. By doing so, air, which enters the ink tank 4 and thus contained in the ink, is sucked and goes into the enclosed space 8, in which the pressure is reduced, through the wall of the ink tube 7. Thus, air can be prevented from gathering and forming air bubbles in the ink tube 7. Accordingly, ink, which does not contain air, is supplied to the recording heads, and thus, a recording operation can be performed on the recording sheet by reciprocating the recording heads in the main scanning direction while a stable ink ejection condition is maintained. The air discharge tube 5 may be provided only on the side near the recording heads, instead of being provided to extend along the entire length of the ink tube 7.

According to the first embodiment of the invention, the air discharge tube 5 has a circular shape and surrounds the ink tube 7 to provide the circular enclosed space 8 between the air discharge tube 5 and the ink tube 7. With this structure, air can be prevented from entering the ink tube 7 through its wall and air contained in the ink tube 7 can be efficiently discharged to the circular enclosed space 8.

Figure 3:
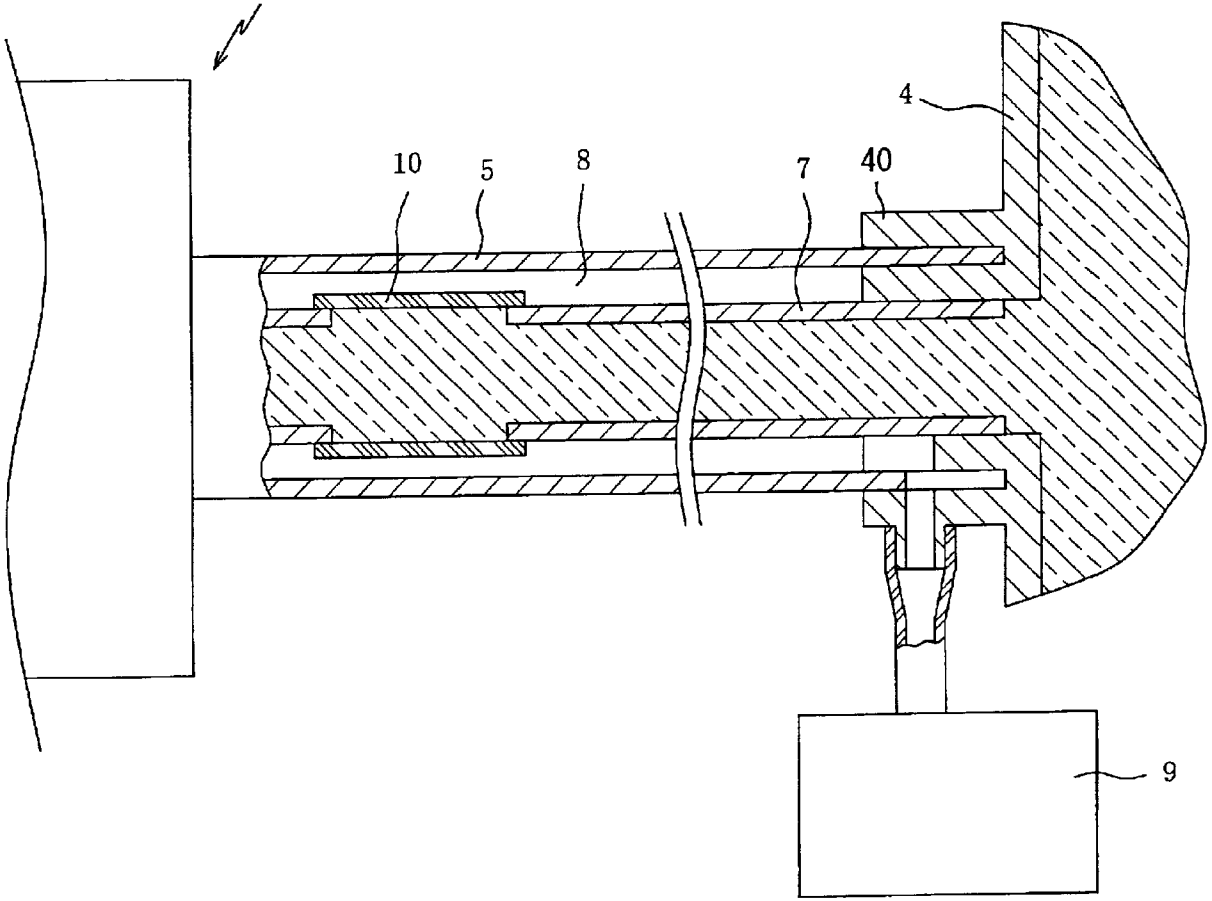
FIG. 3 is an enlarged sectional view showing an ink tube having an air-permeable film and an air discharge tube of a second embodiment of the invention.

Next, a second embodiment of the invention will be described with reference to FIG. 3. Like parts are identified by the same reference numerals as in the first embodiment, and explanations for those parts will be omitted. The second embodiment of the invention has a structure similar to the first embodiment except that the second embodiment has an air-permeable film 10 which has a higher permeability than that of the ink tube 7. The air-permeable film 10 is provided to a part of the wall of the ink tube 7. The air-permeable film 10 has extremely small holes which allow air to pass therethrough but do not allow liquid to pass therethrough. The air-permeable film 10 is preferably made of GORE-TEX (a trademark of Japan Goretex Inc.) or Microtex (a trademark of Nitto Denko Corporation). The air-permeable film 10 is provided to the ink tube 7 near the recording head unit 3.

As described above, the part of the wall of the ink tube 7 is provided with the air-permeable film 10, so that air contained in the ink in the ink tube 7 can be discharged more to the enclosed space 8, in which the pressure is reduced, as compared with discharge of the air from the wall of the ink tube 7. Further, the air-permeable film 10 is provided to the portion near the recording head unit 3, so that entry of air into the recording head unit 3 can be surely prevented or minimized. The position for providing the air-permeable film 10 is not limited to the embodiment. A plurality of the air-permeable films 10 may be provided to several portions of the ink tube 7. By doing so, air generated in the ink tube 7 can be further efficiently discharged.

Figure 4:
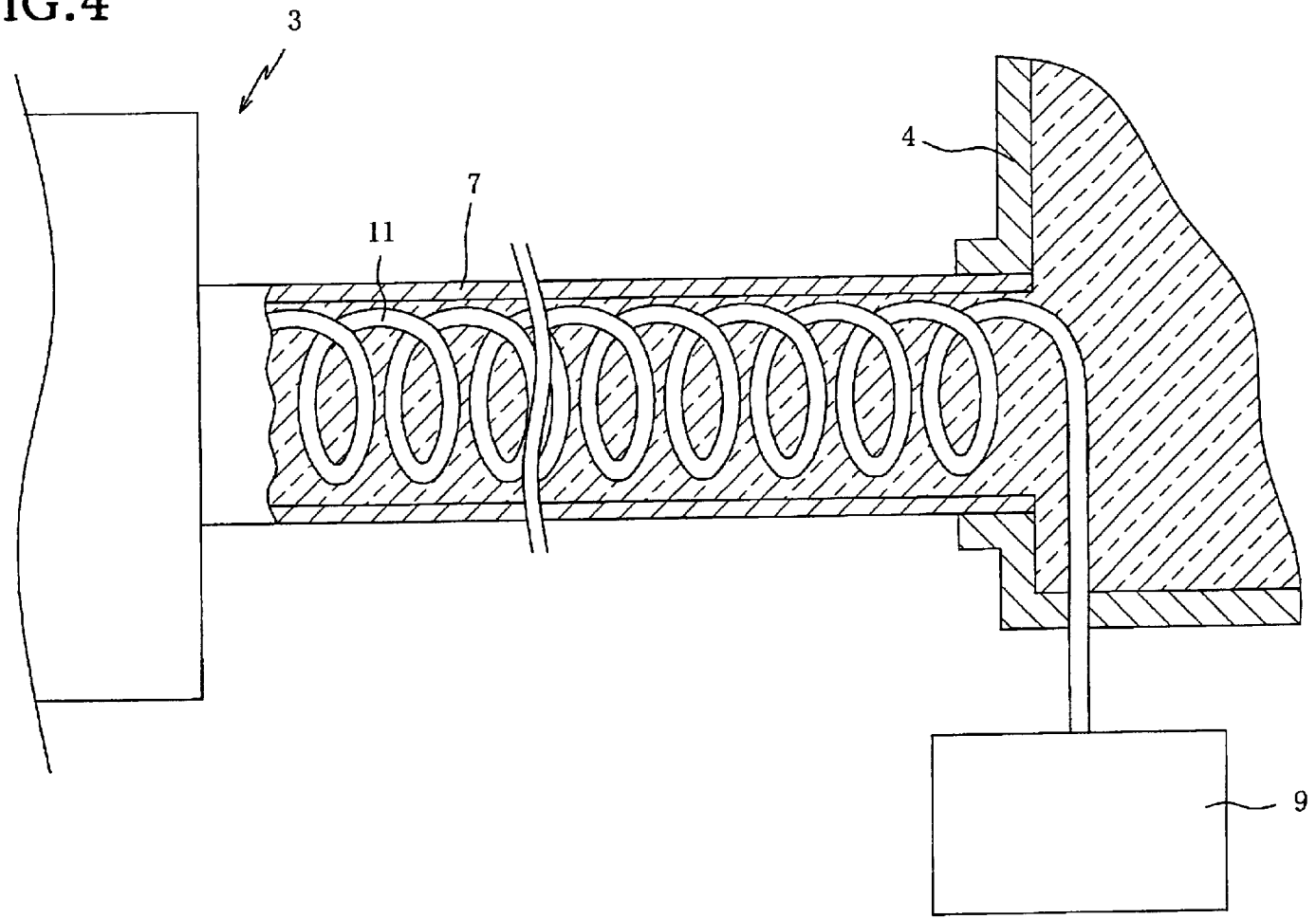
FIG. 4 is an enlarged sectional view showing an ink tube and an air discharge tube of a third embodiment of the invention.

A third embodiment of the invention will be described with reference to FIG. 4. Like parts are identified by the same reference numerals as in the first embodiment, and explanations for those parts will be omitted. In the third embodiment, an air discharge tube 11, which has a smaller diameter than the ink tube 7, is provided inside the ink tube 7, in a spiral fashion. The air discharge tube 11 is made of a flexible material which is the same material as that used for the ink tube 7, and has air-permeability. The air discharge tube 11 provides an enclosed space therein. One end of the air discharge tube 11 is connected with the pressure reducing device 9 that reduces pressure in the air discharge tube 11. By actuating the pressure reducing device 9, the pressure in the air discharge tube 11 (enclosed space) is reduced.

As described above, because the air discharge tube 11 is provided in the ink tube 7, air, which enters the ink tube 7 through the wall of the ink tube 7 and from the ink tank 4, is sucked into the air discharge tube 11 via the wall of the air discharge tube 11 having the air-permeability, by actuating the pressure reducing device 9 to reduce the pressure in the air discharge tube 11 to become lower than atmosphere pressure.

Accordingly, the generation of air bubbles can be restricted in the ink tube 7. The enclosed space for sucking the air contained in the ink is provided by the air discharge tube 11 disposed in the ink tube 7. This structure results in space savings. Further, the air discharge tube 11 is disposed in a spiral fashion in the ink tube 7, so that the surface area to be contacted with the ink can become larger and the air discharge tube 11 can be provided in the ink tube 7 thoroughly. With this structure, air bubbles generated in the ink tube 7 can be efficiently sucked into the air discharge tube 11.

Figure 5A:
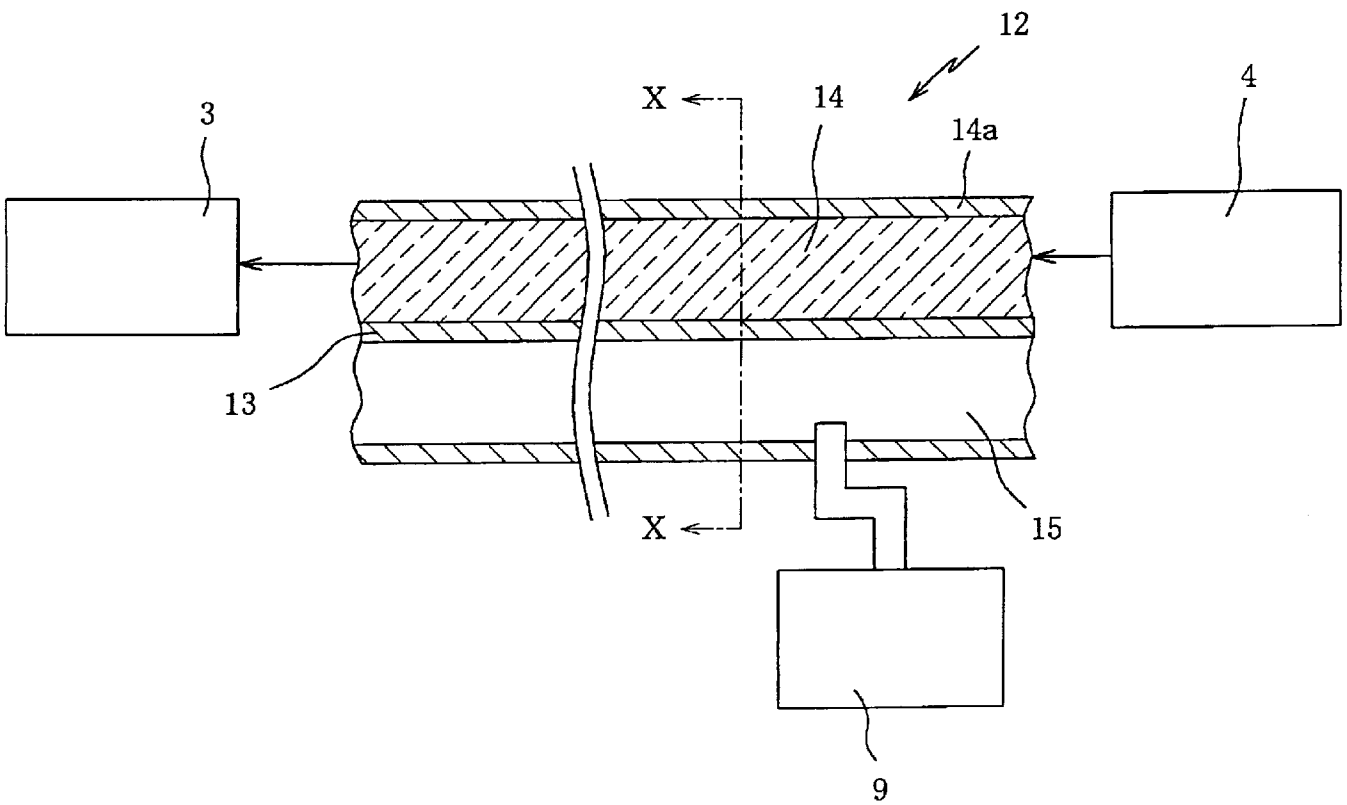
FIG. 5A is an enlarged sectional view showing an ink tube having a partition wall therein of a fourth embodiment of the invention.
Figure 5B:
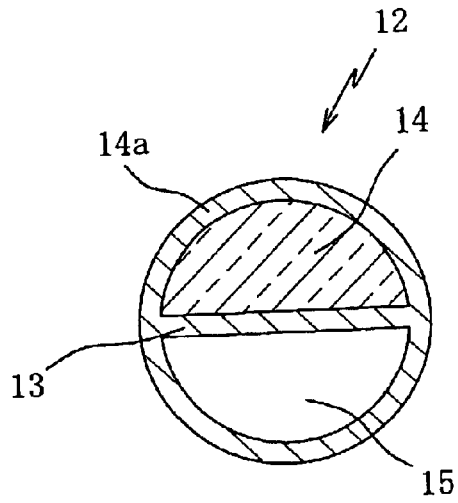
FIG. 5B is a sectional view taken along a line X—X of FIG. 5A.

Referring to FIG. 5, a fourth embodiment of the invention will be described. Like parts are identified by the same reference numerals as in the first embodiment, and explanations for those parts will be omitted.

In the fourth embodiment, an ink tube 12 connects the recording head unit 3 and the ink tank 4. Like the ink tube 7, the ink tube 12 is made of a material having air-permeability. A partition 13 is provided in the ink tube 12 so as to extend in a longitudinal direction of the ink tube 12 to divide the inside of the ink tube 12 into a first chamber 14 and a second chamber 15. The first chamber 14 functions as an ink flow path to supply the ink from the ink tank 4 to the recording head unit 3. Therefore, one end of the first chamber 14 is connected with the ink tank 4, and the other end is connected with the recording head unit 3. The second chamber 15 functions as an enclosed space to suck air bubbles generated in the first chamber 14. The second chamber 15 is connected with the pressure reducing device 9, so that the pressure in the second chamber 15 can be reduced by actuating the pressure reducing device 9.

As described above, the second chamber (enclosed space) 15 is disposed so as to be opposite to the first chamber (ink flow path) 14 while sandwiching the partition 13 therebetween. Therefore, even when air enters the first chamber 14 via its wall 14*a* contacting the outside, the air contained in the ink can be sucked into the second chamber 15 via the partition 13 by actuating the pressure reducing device 9, in a manner similar to the above-described embodiments. Accordingly, the generation of air bubble can be restricted in the first chamber 14. The enclosed space for sucking air bubbles generated in the first chamber 14 comprises the second chamber 15, which is integrated with the first chamber 14. This structure results in space savings.

In the embodiments described above, the enclosed space 8, 15 for sucking air bubbles generated in the ink tube 7 is substantially thoroughly provided to extend along the ink tube 7 in its longitudinal direction. However, for example, the enclosed space 8, 15 may be provided to extend along at least a part of the ink tube 7. Although the ink tube 7 is directly connected to the ink tank 4 in the above-described embodiments, a holder member, to which the ink tank 4 is detachably attached, is provided and the ink tube 7 and the pressure reducing device 9 may be connected with the holder member.

According to the ink-jet recording apparatus 1 described in the above-described embodiment, a member for providing the enclosed space 8, 15 is provided at at least a portion of the ink tube 7 and the pressure reducing device 9 is provided to reduce pressure in the enclosed space 8, 15, so that the enclosed space 8, 15, in which the pressure is reduced, can be provided to extend along at least the portion of the ink tube 7. Thus, the generation of air bubbles can be restricted in the ink tube 7 by sucking air contained into the enclosed space 8, 15. Accordingly, air bubbles, which may close the ink flow path and the nozzles, are prevented from being conveyed to the recording heads with the ink. Consequently, an ink-ejection failure and deterioration of the printing quality can be avoided.

While the invention has been described in detail with reference to specific embodiments thereof, it would be apparent to those skilled in the art that various changes and modifications may be made therein without departing from the spirit of the invention.

What is claimed is:

1. An ink-jet recording apparatus comprising:

a recording head that ejects ink;

an ink tank that is provided separately from the recording head and stores the ink therein;

an ink tube that supplies the ink from the ink tank to the recording head;

a member that provides an enclosed space, extending along at least a portion of the ink tube; and a pressure reducing device that reduces pressure in the enclosed space.

2. The ink-jet recording apparatus according to claim 1, wherein the member has a cylindrical shape to surround the ink tube and provides the circular enclosed space around the ink tube, between the member and the ink tube.

3. The ink-jet recording apparatus according to claim 2, wherein the ink tube has a wall and at least a part of the wall, contacting the circular enclosed space, is made of an air-permeable film.

4. The ink-jet recording apparatus according to claim 1, wherein the member is a tube having air-permeability and has a smaller diameter than the ink tube, and provided in the ink tube.

5. The ink-jet recording apparatus according to claim 4, wherein the tube is provided in a spiral fashion to extend along a longitudinal direction of the ink tube.

6. The ink-jet recording apparatus according to claim 1, wherein the member includes a partition wall that is provided in the ink tube and extends in the longitudinal direction of the ink tube to divide the inside of the ink tube into a plurality of chambers, wherein one of the chambers is used to supply the ink and another of the chambers is used to provide the enclosed space.

7. An ink-jet recording apparatus comprising:

a recording head that ejects ink;

an ink tank that stores the ink;

an ink tube coupled between the recording head and the ink tank to supply the ink from the ink tank to the recording head; and an air discharge member extending along the ink tube and being connected to a vacuum source that reduces pressure in the air discharge member to reduce air bubbles in the ink contained in the ink tube.

8. The ink-jet recording apparatus according to claim 7, wherein the air discharge member includes a tube that surrounds the ink tube and provides an enclosed space around the ink tube between the air discharge member and the ink tube.

9. The ink-jet recording apparatus according to claim 8, wherein at least a part of the ink tube in contact with the enclosed space is made of an air-permeable film.

10. The ink-jet recording apparatus according to claim 7, wherein the air discharge member includes a tube having air-permeability and being disposed inside the ink tube.

11. The ink-jet recording apparatus according to claim 10, wherein the tube is provided in a spiral fashion to extend along a longitudinal direction of the ink tube.

12. The ink-jet recording apparatus according to claim 7, wherein the air discharge member includes a common wall shared with the ink tube and extending along the ink tube such that the air bubbles in the ink is drawn through the common wall into the air discharge member.

13. An ink-jet recording apparatus comprising:

an ink tank that stores ink;

a recording head that ejects the ink and is provided separately from the ink tank;

an ink tube coupled between the recording head and the ink tank to supply the ink from the ink tank to the recording head;

an air discharge tube extending along the ink tube and having an air permeable wall; and a vacuum source connected to the air discharge tube to reduce the pressure therein to draw air bubbles present in the ink in the ink tube through the air permeable wall.

14. The inkjet recording apparatus according to claim 13, wherein the air discharge tube is disposed inside the ink tube.

15. The inkjet recording apparatus according to claim 13, wherein the air discharge member surrounds the ink tube.

16. A method of supplying ink to a recording head, the method comprising:

providing an ink tube that connects an ink tank that stored ink to a recording head that ejects the ink;

placing an air discharge member that extends along the ink tube; and lowering the pressure in the air discharge member to reduce air bubbles in the ink contained in the ink tube.

17. The method according to claim 16, wherein the step of placing includes placing a tube that surrounds the ink tube to define an enclosed space around the ink tube between the air discharge member and the ink tube.

18. The method according to claim 17, wherein at least a part of the ink tube in contact with the enclosed space is made of an air-permeable film.

19. The method according to claim 16, wherein the step of placing includes placing a tube having air-permeability inside the ink tube.

20. The method according to claim 19, wherein the step of placing further includes placing the tube in a spiral fashion to extend along a longitudinal direction of the ink tube.

21. The method according to claim 16, wherein the air discharge member includes a common wall shared with the ink tube and extends along the ink tube such that the air bubbles in the ink is drawn through the common wall into the air discharge member.

* * * * *